United States Patent [19]

Jones

[11] Patent Number: 4,875,355

[45] Date of Patent: Oct. 24, 1989

[54] MANUFACTURE OF WIRE BINDING ELEMENTS

[75] Inventor: Leonard W. N. Jones, Hindhead, Great Britain

[73] Assignee: James Burn International Ltd., Great Britain

[21] Appl. No.: 196,015

[22] Filed: May 19, 1988

[30] Foreign Application Priority Data

May 22, 1987 [GB] United Kingdom ..... 8712148

[51] Int. Cl.[4] ..... B21F 45/16

[52] U.S. Cl. ..... 72/306; 72/195; 140/71 R

[58] Field of Search ..... 140/71 R, 82, 105; 72/187, 312, 195, 306

[56] References Cited

U.S. PATENT DOCUMENTS

| | | | |
|---|---|---|---|
| 2,130,069 | 9/1938 | Criley | 72/195 |
| 3,540,527 | 11/1970 | Greenfell et al. | 72/201 |
| 3,566,927 | 3/1971 | Adams | 140/71 R |
| 4,721,136 | 1/1988 | Negro | 140/71 R |

*Primary Examiner*—Lowell A. Larson
*Attorney, Agent, or Firm*—Wood, Herron & Evans

[57] ABSTRACT

A machine for transforming zigzag wire to the slotted tubular form ready for use as a binding element comprises means for feeding a strip of zigzag wire longitudinally, means for arresting the feed of each prong of the wire strip as it reaches a shaping station, means for clamping each prong at that station and means at the station for shaping each clamped prong. The shaping means comprises two or more forming tools mounted on rollers which are driven by drive shafts, at least one roller being angularly adjustable relative to its drive shaft. This allows the operation of the forming tools to be synchronized so that symmetrical shaping of the zigzag wire is achieved. The feed means are rotary and means are provided whereby the feed of each prong is arrested for at least one eighth of each revolution of the rotary feed means. The shaping of the zigzag strip is facilitated and improved since the strip is held stationary for a relatively long period of time.

12 Claims, 8 Drawing Sheets

Figure 1:
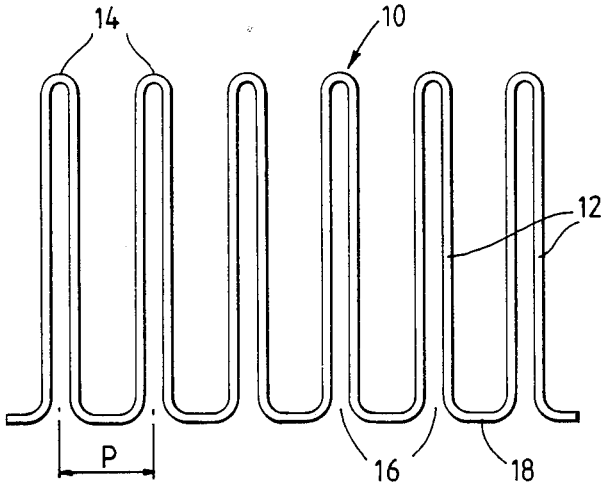

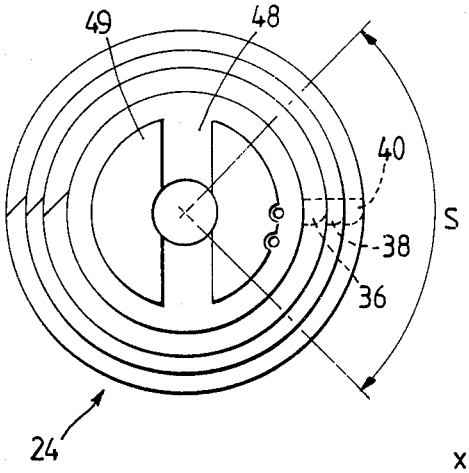
Fig.6.
Fig.6a.
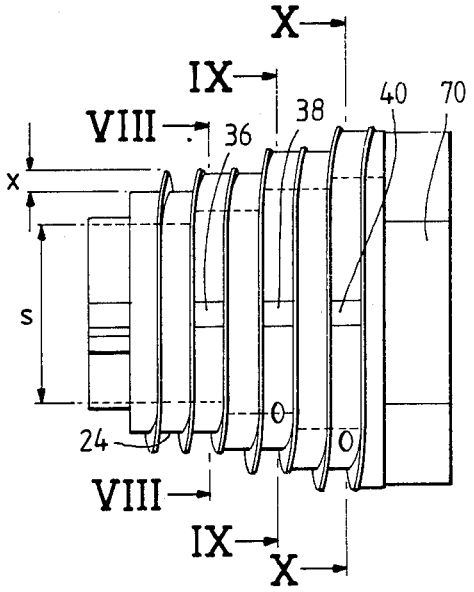
Fig.7.
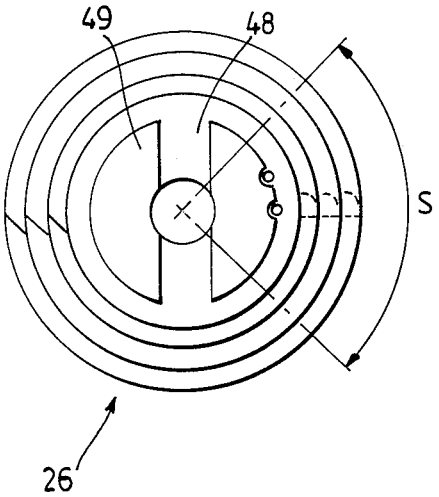
Fig.7a.
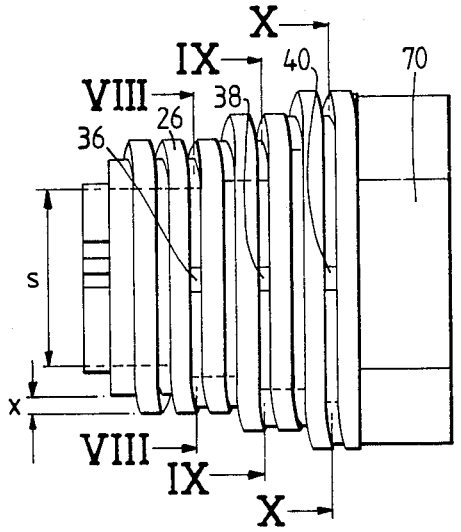

MANUFACTURE OF WIRE BINDING ELEMENTS

This invention relates to the manufacture of wire binding elements for perforated sheets.

A well known method of binding perforated sheets uses binding elements which are lengths of wire bent so as to form curved prongs on which the sheets are impaled. The element is provided at the time of the impaling operation in the form of a tube having a longitudinal slit in its wall and the final stage in the binding process is to close the slot by bringing the closed ends of the prongs into their open ends.

Such elements are generally manufactured by firstly converting a length of wire to the so-called 'zig-zag' form, hereinafter referred to as a strip of zigzagged wire of the kind set forth, in which the wire assumes the shape of a flat comb of indefinite length, the prongs of which are 'closed' at their tips and 'open' at their bases or roots which are connected to their neighbors by aligned lengths of wire forming the stock or spine of the comb so that the pitch of the prongs corresponds to the pitch of the perforations in the sheets to be bound. A long length of such flat zig-zag material is then bought to the slotted tube form, hereinafter referred to as the slotted tubular form as set forth herein, by suitable bending of the prongs.

The conversion of a strip of zigzagged wire of the kind set forth to the slotted tubular form may be effected in several different ways. One machine which has been used has means for feeding the strip longitudinally, means for arresting the feed of each prong as it reaches a shaping station, means for clamping a portion of each prong at that station and means at the station for shaping each clamped prong into the desired configuration. Such a machine will hereinafter be referred to as 'a binding element forming machine of the type described'.

In such machines, the shaping is often effected by clamping the prongs of the strip of zigzagged wire on an anvil whose width is such that their roots and tips are unsupported. Hammers provided at the shaping station then strike the overhanging portions and cause them to conform to a shape determined by the anvil. These hammers are commonly mounted on rotors whose axes are fixed relative to the anvil with the hammers being adjustable relative to the rotors such that the distance between the anvil and the hammers can be varied.

It is important that both overhanging portions of the prongs should be struck simultaneously in order to achieve symmetrical bending. However, due to manufacturing errors this is often not the case and it is extremely difficult to achieve synchronization by adjusting each hammer separately.

A binding element forming machine of the type described in accordance with one aspect of the invention has a shaping means which comprises two or more forming tools mounted on rollers which are driven by drive shafts, wherein at least one rollers is angularly adjustable relative to its drive shaft.

This arrangement provides a simple and practicable way of adjusting the relationship between the forming tools, which are mounted on the rollers, to ensure that symmetrical shaping of the strip of zigzagged is achieved.

Preferably, the shaping means further comprises an anvil on which each prong of the strip of zigzagged wire is clamped by the clamping means such that its root and tip overhang the anvil. The forming tools are arranged to strike the overhanging portions on either side of the clamped prong to cause them to conform to a shape determined by the anvil. By angularly adjusting at least one roller relative to its drive shaft, the timing of the forming operations can be synchronized so that both ends of the prongs are struck simultaneously. Preferably the rollers are connected to the drive shafts via a drive key, the position of each drive key being adjustable relative to the respective shaft.

Preferably the connection between the drive shafts and the rollers also comprises a full length offset key which prevents any synchronization error during initial assembly of the rollers.

In a preferred embodiment the rollers effect the feed by having helical grooves in which the tips and the roots of the prongs engage, the forming tools being housed in the grooves. Each convolution of the helical grooves has a portion lying in a plane at right angles to the longitudinal axis which serves to arrest the feed of each prong while it is being shaped.

Suitably, a cooling device is positioned within the anvil to cool the rollers to allow maximum speed of forming without excess heating.

Conveniently, the anvil is split and its vertical position may be adjusted by wedges positioned between the two portions of the anvil. The wedges may be manually or mechanically driven in and out of the split to raise or lower the anvil. This allows the machine to be adjusted whilst operating rather than stopping a production run and changing the position of the clamping means.

A binding element forming machine in accordance with another aspect of the invention comprises a rotary feed means, and means whereby the feed of each prong is arrested for at least one eighth, preferably one quarter, of each revolution of the rotary feed means.

In known machines which have rotary feed means, the prongs have been held stationary for a relatively short time. However, it has been found that the positioning and forming of the prongs is greatly improved if they can be held stationary for a greater portion of each revolution of the feed means. Furthermore, this allows the prongs to be much more accurately clamped.

Preferably, the feed means comprises driven rollers having helical grooves in which the tips and roots of the prongs engage. Suitably at least one eighth, preferably one-quarter, of each convolution of the helical grooves lies in a plane at right angles to its longitudinal axis and serves to arrest the feed of each prong while it is being shaped.

Figure 2:
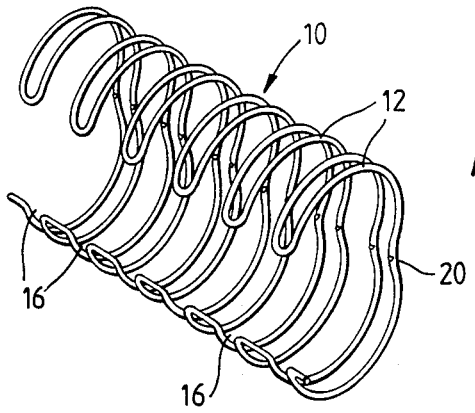
Figure 3:
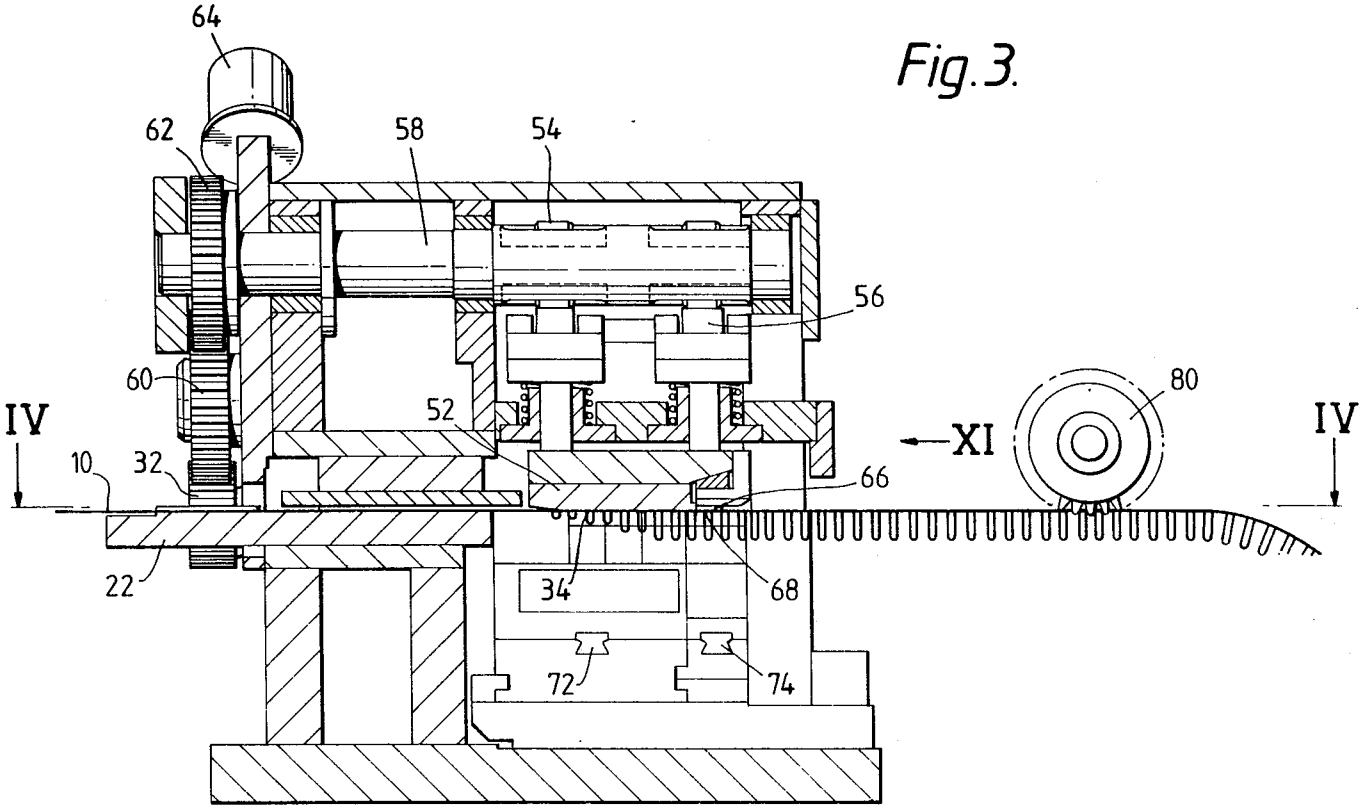
Figure 4:
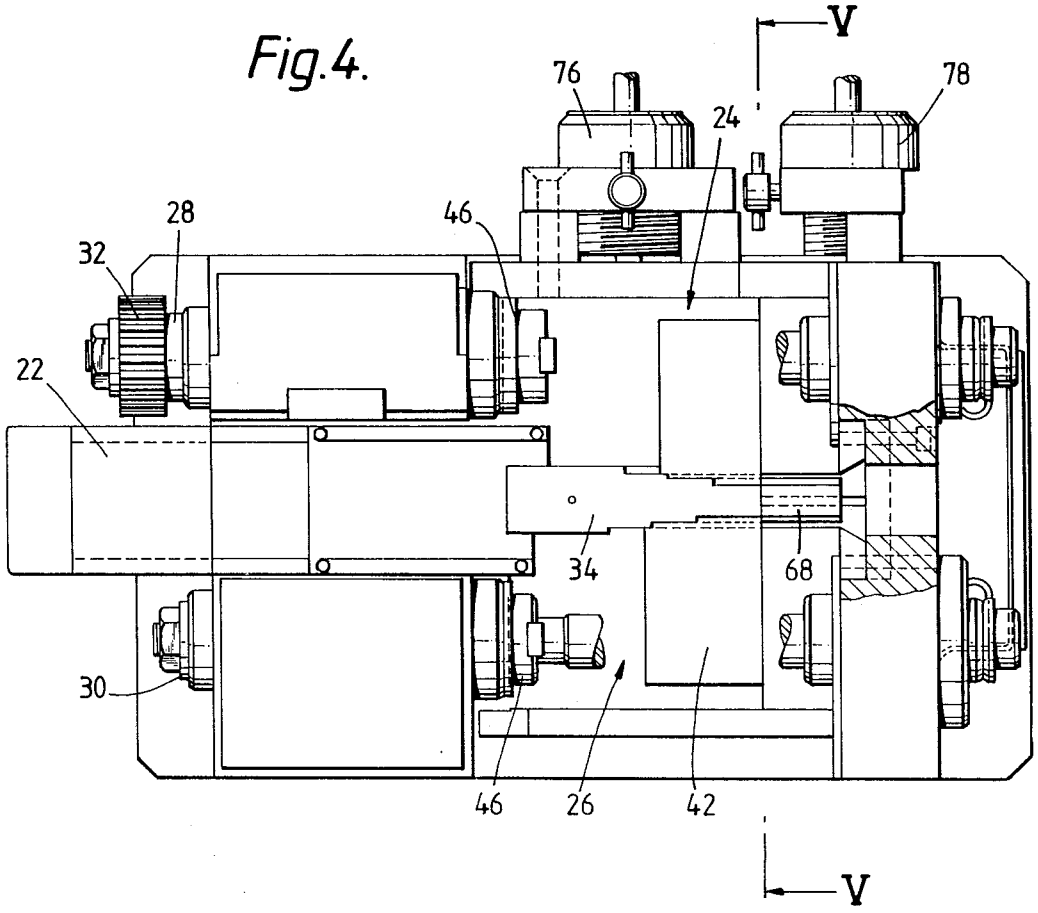
Figure 5:
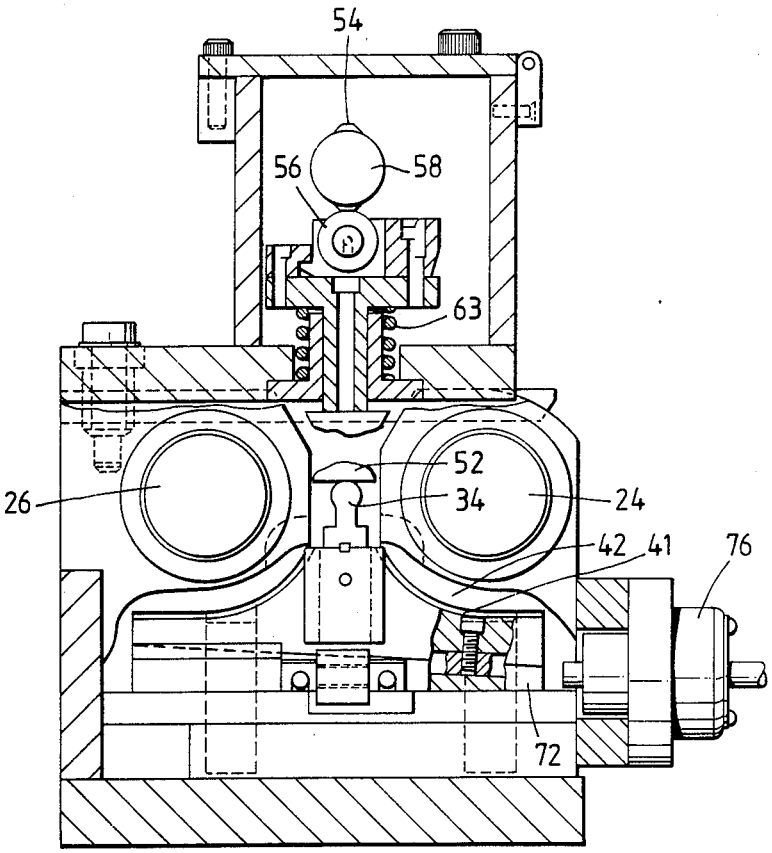

The invention will now be further described by way of example with reference to the accompanying drawings in which:

FIG. 1 shows a strip of zig-zag wire for use in a binding element forming machine of the type described, FIG. 2 shows a length of slotted tube formed from the wire shown in FIG. 1, FIG. 3 is a part sectional side view of a binding element forming machine in accordance with the present invention, FIG. 4 is a plan view in the direction of arrows IV—IV of FIG. 3, FIG. 5 is a part sectional view taken in the direction of arrows V—V of FIG. 4.

Figure 8:
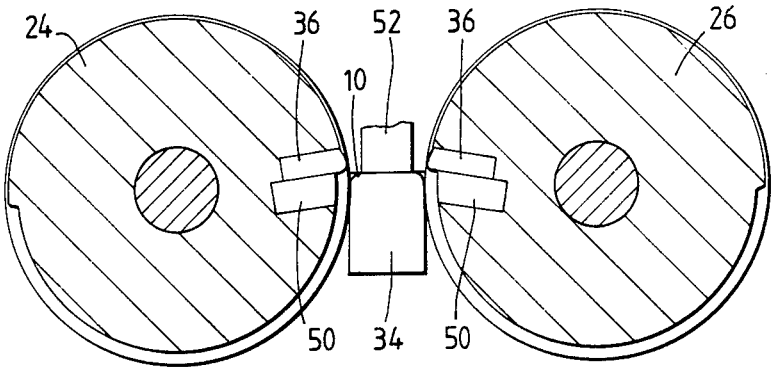
Figure 9:
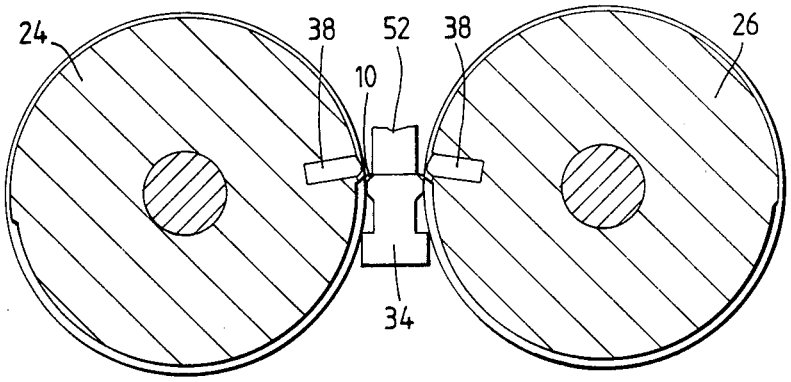
Figure 10:
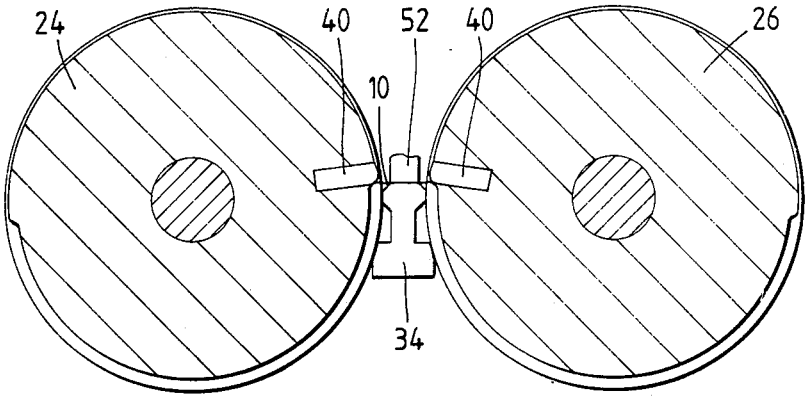
Figure 11:
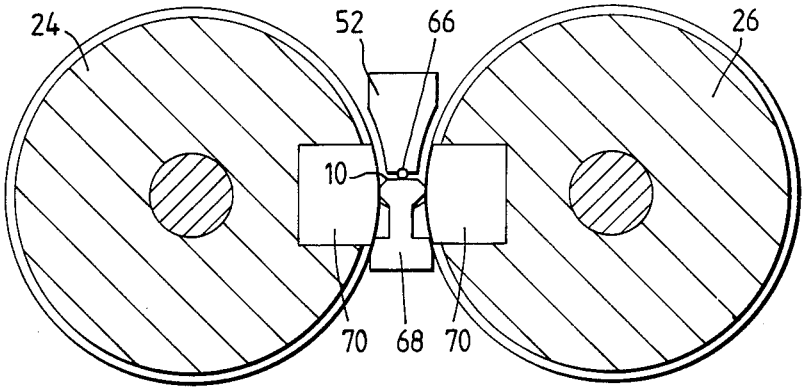
Figure 12:
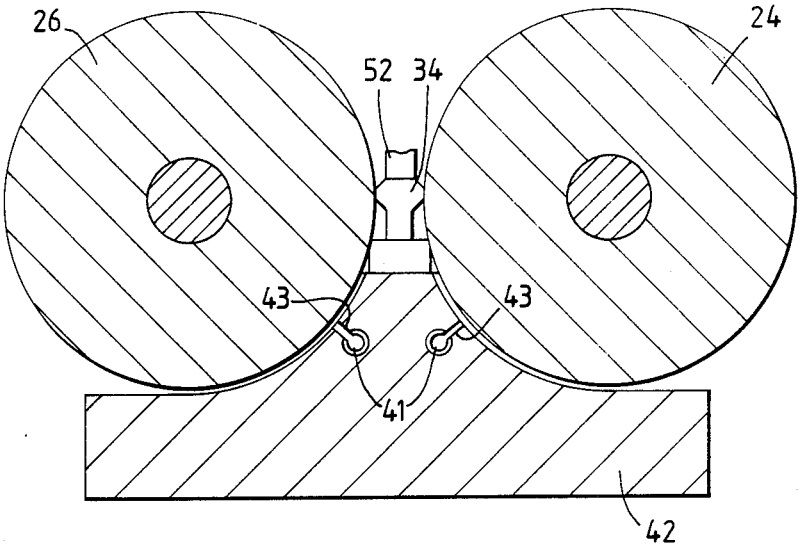
Figure 13:
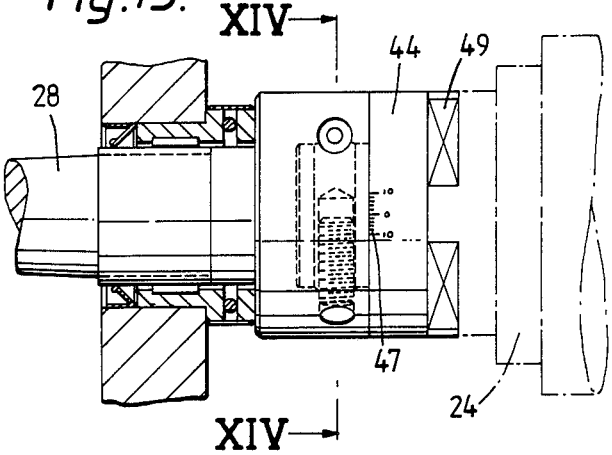
Figure 14:
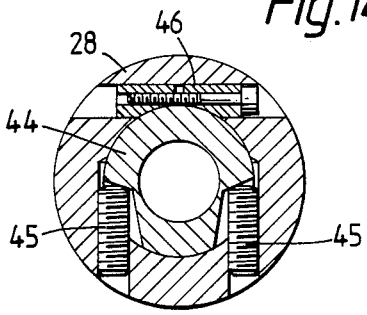

FIGS. 6 and 6*a* are respectively an end view and a side view of one of the rollers of the binding element forming machine, FIGS. 7 and 7*a* are respectively an end view and a side view of the other roller of the binding element forming machine, FIGS. 8 to 10 are sections taken through FIG. 6*a* and 7*a* at VII to X respectively and show the steps of conveying the zigzag strip to the slotted tubular form, FIG. 11 is a view taken along the arrow XI of FIG. 4, FIG. 12 is a similar view to that of FIGS. 8 to 11 showing the air cooling of the rollers, FIG. 13 is a part sectional view of the connection between the rollers and the rotary drive, and FIG. 14 is a section along the line XIV—XIV of FIG. 13.

The strip 10 shown in FIG. 1 is comblike having prongs 12 closed at their tips 14 and open at their roots 16 where they are connected by lengths of wire 18. In the condition of use illustrated in FIG. 2 the prongs 12 have been curved so that perforated sheets can be impaled. That operation being performed, the binding is completed by bringing the tips 14 of the prongs into the roots or open ends 16, which operation is facilitated by an indentation on either the convex or the concave surface of that part of each prong which is midway between its tip and root, 20.

Referring to FIGS. 3 onwards, the machine has a feed table 22 on which the zigzag strip 10 is longitudinally fed. It is thus presented to a pair of stepped rollers 24, 26 which have been omitted from FIG. 4 for clarity, but whose positions are shown.

The stepped roller 24 shown in detail in FIGS. 6 and 6*a* has a helical groove or scroll the pitch of which is that of the prongs of the zigzag strip 10. The width of the groove is slightly larger than the dimension 'P' in FIG. 1. The stepped roller 26 shown in FIGS. 7 and 7*a* has a similar groove of the same pitch but of opposite hand and the width of which is slightly larger than the tip 14 of the prongs 12 of the zigzag strip 10. Rotation of the rollers in opposite directions with the strip engaged in their grooves results in longitudinal movement of the strip over the table 22. The rollers 24, 26 are driven from a main roller drive by means of drive shafts 28 30 and a roller drive gear 32.

It has been found that scrolls of the widths described result in reduced friction and heat build-up. In known machines where the width of the scroll 24 was equal to dimension 'P' and the width of the scroll 26 was equal to the tip of the prong 14, excessive heat was generated at speeds of 1000 loops per minute which caused the shaping means to seize and produced dimensional instability in the binding elements produced. By widening the scrolls, higher operating speeds may be achieved without danger of overheating. Advantageously the depth of the grooves, dimension X on FIGS. 6*a* and 7*a*, may also be arranged to further reduce friction and heat build-up.

The table 22 has an extension 34 between the rollers 24, 26 the top of which is such that when a tooth of the zigzag passes onto the extension 34 from the table 22 its ends project beyond the edges of the extension and lie in the grooves of the scrolls. A guide is provided along the feed table to align the zigzag strip accurately before it reaches the scrolls.

FIGS. 6, 6*a*, 7 and 7*a* show that for each convolution of the scroll a sector S, which is about one quarter of a circle, is straight i.e. lies in a plane at right angles to the longitudinal axis of the cylinder. When the zig-zag is engaged in that part of the grooves its progression along the table 22 is arrested. It is at this moment that the shaping of a prong is effected. A striker or homer 36 is mounted in the portion S of a convoltion of the grooves which strikes the ends of each prong and causes them to bend to a shape determined by the extension 34 of the feed table, 22 which acts as an anvil. In a further convolution, there is a further hammer 38 at a greater radial distance from the longitudinal axis of the roller which, on continued rotation of the latter, causes the partially bent zigzag to be further bent to the position shown in FIG. 10. The final tubular form is achieved by a third hammer 40 (FIG. 11).

To prevent overheating when the machine is operated at high speeds the rollers are cooled by air. Air supply passages 41 pass through a block 42 below the anvil 34 (see FIG. 12). Holes 43 are provided along the block 42 which cause jets of air to be directed at both the rollers 24 26. The holes 43 are so positioned that they cause jets of air to blow along those portions of the grooves of the rollers 24 26 which are adjacent the anvil 34. Thus when the hammers are striking the tips and prongs of the strip and are, therefore adjacent the anvil, they are cooled by the air jets. This allows the speed of the forming operation to be high without risk of the strip becoming overheated and the final shape thereof, being adversely affected.

To achieve symmetrical bending of the prongs, the hammers 36. 38 or 40 must strike both ends simultaneously. However, because of manufacturing errors the correct relationship of the strikers to the anvil is often not achieved when the shaping means are assembled The rollers 24, 26 are therefore each provided with an adjustable connection to the respective drive shaft 28, 30. As shown in FIG. 13 and 14, each drive shaft 28, 30 has a generally circular aperture in which the scroll drive key 44 sits. Two parallel screw holes are provided in the drive shaft 28, 30 in either side of the circular aperture for two socket screws 45 which hold the suitably shaped drive key 44 in place. The position of the scroll 24, 26 relative to the drive shaft 28, 30 is adjusted by means of a clamping screw 46, the hole for which runs through the drive shaft 28, 30 perpendicularly to the socket screw holes. Rotation of this clamping screw to move it in or out of the shaft causes the angular position of the scroll 24, 26 relative to the drive shaft 28, 30 to be changed. In other words, the orientation of the drive key 44 is altered in order to adjust the roller 24, 26 on the drive shaft 28, 30. This is accomplished by rotation of the clamping screw 46 which exerts a frictional force on the drive key 44 as it moves into or out of the shaft 28, 30.

The drive key has a micrometric scale 47 marked thereon, and an indicator therefore is attached to the clamping screw. This allows very accurate adjustment of the scrolls relative to the shafts rather than the trial and error adjustment necessary in known machines. Moreover, the adjustment can be carried out with the scrolls in position in the machine merely by rotating the clamping screw. In known machines the scrolls had to be removed from the machine in order to adjust them relative to the drive shafts.

The connection between the drive keys and the scrolls comprises a male locking element provided on the drive key which locates in slots 48 on the scrolls (see FIGS. 6 and 7). Full length offset keys 49 prevent 180° error between them when the machine is initially set up. Each full length offset key 49 is slightly offset from the axis of roller 24, 26. This asymmetrical characteristic means that the roller 24, 26 can only be positioned in one orientation with respect to the drive key 44 and, hence, the drive shaft 28, 30.

A platform or cam surface 50 is provided in each groove of the scrolls in a position so that it engages the outermost part of each prong immediately before it is clamped. The platforms are adjusted to the exact width of the wire at the respective stage to cause the strip to be positioned centrally on the anvil 34. Adjustment of the roller position by means of the drive keys 46 to ensure that the hammers strike simultaneously also ensures that the platforms 50 engage simultaneously.

The central parts of the prongs are clamped by a pressure pad 52 while the ends are being struck by the hammers which is caused to grip the strip between itself and the anvil 34 when the movement of the zigzag along the table is arrested. In FIG. 4 a preferred form of clamp actuation means is shown which comprises two double lob cams 54 which act directly onto two followers 56 connected to the pressure pad 52. The clamp actuation means are described in greater detail in our simultaneously filed Application No. 196,365. The cams 54 are mounted on a cam shaft 58 which is driven from the main roller drive by means of an idler gear 60 which connects the roller drive gear 32 to a cam shaft drive gear 62. The cams cause the followers and therefore the pressure pad which is attached thereto to move downwards. The followers and pressure pad are raised after the cams have moved past by action of a spring 63. Both the cambox and the gearbox driving the rollers are preferably totally enclosed and provided with a lubricant bath supplied from an oil reservoir 64 to aid lubrication and disperse heat.

The pressure pad 52 has a projection 66 (FIG. 11) which serves to put the indentation referred to above into the convex side of the prongs in the last stage of forming. An anvil extension 68 has a depression which matches the projection 66. An insert 70 on each scroll serves to centralize the prongs on the anvil extension 68. The indentation may be formed on the concave side of the prongs and it has been found that this more effectively controls the point of bending in the final binding operation. Furthermore, the indentation may be formed by a cutting rather than a forming operation and may be produced before the zigzag wire is converted to the slotted tubular form.

Both the anvil 34 and the anvil extension 68 are split and may be raised or lowered by the action of wedges 72, 74. The wedges can be adjusted manually or may be driven, for example by a DC servo motor 76, 78. This allows the machine to be adjusted whilst operating rather than having to interrupt the production run and change the position of the pressure pad by adjusting the followers 56 as is necessary in known machines.

A starwheel 80 is provided at the exit end of the machine to advance the wire out of the shaping means and to control and adjust the pitch of the binding elements to the required dimensions.

What I claim is:

1. A binding strip forming machine comprising rotary feed means for feeding a multi-prong binding strip into a forming station in response to rotation of said rotary feed means, arresting means connected with said rotary feed means for arresting the feed of successive prongs in said forming station, these successive prongs being so arrested for at least one-eighth of each revolution of said rotary feed means, and forming means located at said forming station for forming successive prongs of said binding strip into a desired configuration, said forming means being operative during that at least one-eighth of each revolution of said rotary feed means when said arresting means is arresting the feed of said binding strip.

2. A binding strip formed machine as set forth in claim 1, the feed of each prong being arrested for at least one quarter of each revolution of said rotary feed means.

3. A binding strip forming machine as set forth in claim 1, said machine comprising an anvil at said forming station adapted to support said binding strip therein, a forming roller disposed laterally of said anvil on each side thereof, each roller being rotatable on an axis generally parallel to the longitudinal axis of said binding strip, at least one forming tool on each roller, said forming tools being adapted to strike opposed ends of each prong upon rotation of said forming rollers for forming said binding strip, and an adjuster mechanism connected with at least one of said rollers, said adjustor mechanism being operable to cause each said forming tool to strike a prong simultaneously during rotation of said forming tools.

4. A binding strip forming machine as set forth in claim 3, said machine comprising a clamp mechanism for holding said binding strip on said anvil during forming thereof, said anvil being dimensioned so that the root and tip of each prong overhang opposite sides of said anvil.

5. A binding strip forming machine as set forth in claim 3, each of said rollers comprising a helically grooved surface, the tip and root of each prong being engageable with said helically grooved surface to move said binding strip into said forming station upon rotation of said rollers.

6. A binding strip forming machine as set forth in claim 5, at least one-eighth of each convolution of said helically grooved surface lying in a plane at right angles to said roller's longitudinal axis to form a flatted surface, said flatted surface functioning to arrest the feed of each prong as it is shaped.

7. A binding strip forming machine as set forth in claim 6, at least one quarter of each convolution of said helically grooved surface lying in a plane at right angles to its longitudinal axis to form a flattened surface.

8. A binding strip forming machine comprising an anvil at a forming station adapted to support a multi-prong binding strip, a forming roller oriented laterally of said anvil on each side thereof, each roller being rotatable on an axis generally parallel to the longitudinal axis of said binding strip, at least one forming tool on each roller, said forming tools being adapted to strike opposed ends of each prong upon rotation of said forming rollers for forming said multi-prong binding strip, and an adjustor mechanism connected with at least one of said rollers, said adjustor mechanism being operable to cause said forming tool of each said forming roller to strike a prong simultaneously during rotation thereof.

9. A binding strip forming machine as set forth in claim 8, said machine comprising a clamp mechanism for holding said binding strip on said anvil during forming thereof, said anvil being dimensioned so that the root and tip of each prong overhang opposite sides of said anvil.

10. A binding strip forming machine as set forth in claim 8, each of said rollers comprising a helically grooved surface, the tip and root of each prong being engageable with said helically grooved surface to move said binding strip into said forming station upon rotation of said rollers.

11. A binding strip forming machine as set forth in claim 8, said adjustor mechanism comprising a drive key for connecting a forming roller to a drive shaft, the position of said drive key being adjustable relative to said drive shaft.

12. A binding strip forming machine as set forth in claim 8, that connection between said drive shaft and said forming roller also comprising a full length offset key.

* * * * *

UNITED STATES PATENT AND TRADEMARK OFFICE

CERTIFICATE OF CORRECTION

PATENT NO. : 4,875,355

DATED : October 24, 1989

INVENTOR(S) : L.W.N. Jones

It is certified that error appears in the above-identified patent and that said Letters Patent is hereby corrected as shown below:

Column 1, line 59 "rollers" should be --roller--

Column 4, line 2 "homer" should be --hammer--

Column 6 line 8 "formed" should be --forming--

Signed and Sealed this

Eleventh Day of June, 1991

*Attest:*

HARRY F. MANBECK, JR.

*Attesting Officer*

*Commissioner of Patents and Trademarks*